US005213432A

United States Patent [19]

Chappell

[11] Patent Number: 5,213,432

[45] Date of Patent: May 25, 1993

[54] BRUSH WITH AUTOMATIC FLOW CONTROL VALVE

[76] Inventor: Gilmore H. Chappell, P.O. Box 5408, Deptford, N.J. 08096

[21] Appl. No.: 622,458

[22] Filed: Dec. 5, 1990

[51] Int. Cl.[5] ..... A46B 11/02; A46B 11/06

[52] U.S. Cl. ..... 401/273; 401/24; 401/140; 401/275; 401/289; 401/204

[58] Field of Search ..... 401/140, 289, 273, 275, 401/24, 204, 273, 275

[56] References Cited

U.S. PATENT DOCUMENTS

| | | | |
|---|---|---|---|
| 219,324 | 9/1879 | Sunderlin | 401/24 |
| 226,565 | 4/1880 | Sunderlin | 401/24 |
| 2,137,944 | 11/1938 | MacLeod | 401/140 |
| 2,789,298 | 4/1957 | Peterson | 401/270 X |

FOREIGN PATENT DOCUMENTS

| | | | |
|---|---|---|---|
| 294030 | 12/1988 | European Pat. Off. | 401/273 |
| 2918257 | 11/1980 | Fed. Rep. of Germany | 401/270 |
| 2932110 | 2/1981 | Fed. Rep. of Germany | 401/140 |
| 1316710 | 12/1962 | France | 401/140 |
| 357675 | 10/1931 | United Kingdom | 401/270 |

*Primary Examiner*—Steven A. Bartlie

*Attorney, Agent, or Firm*—Caesar, Rivise, Bernstein, Cohen, & Pokotilow, Ltd.

[57] ABSTRACT

A brush with an automatic water control valve is disclosed. The brush includes a handle portion pivotably connected to an actuation portion and rigidly attached to a brush portion. A fluid passageway is provided through the handle portion into the bristles of the brush. Communicating with the fluid passageway is the flexible tubing which is adapted to be connected to a water fluid source under pressure. A valve is provided for opening and closing the passageway formed by the tubing and for providing flow through the passageway to the brush portion. The valve is actuated by a pivoting motion of the actuation portion with respect to the handle portion. The valve includes a roller which engages the flexible tubing and squeezes same, such that the normal rest position of the actuation portion with respect to the handle portion closes the tubing. Upon angling or pivoting of the actuation portion about the pivot on handle portion, the passageway is open so that fluid may be pass into the bristles of the brush in a controlled manner.

10 Claims, 4 Drawing Sheets

FIG. 6
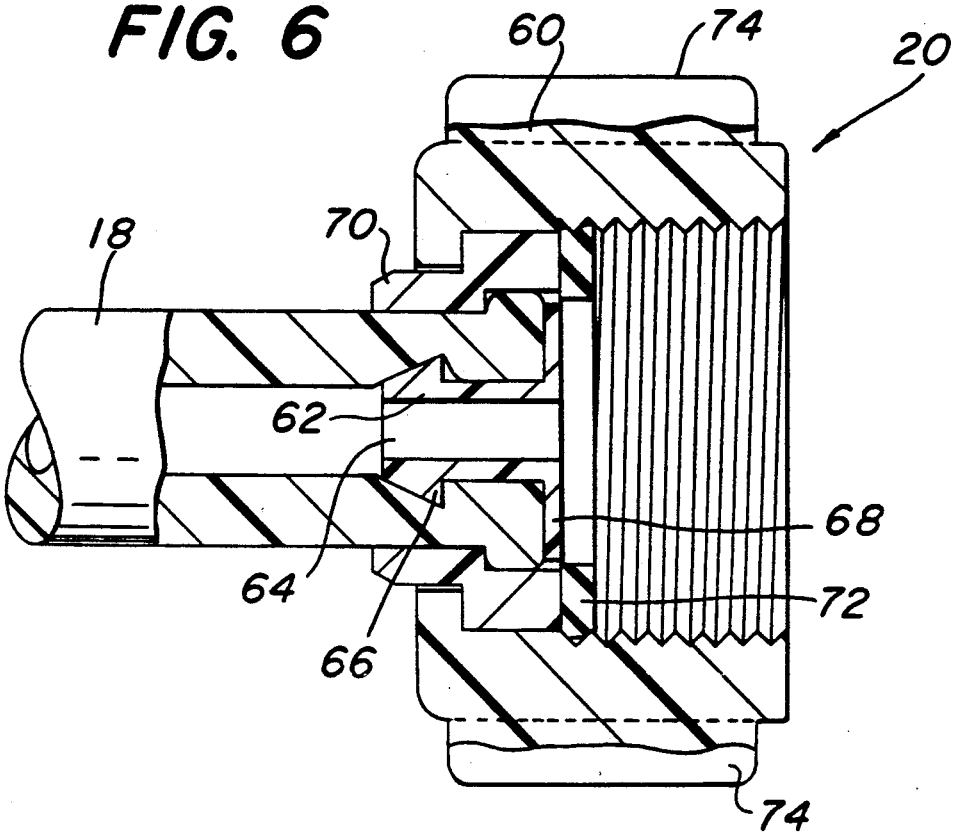
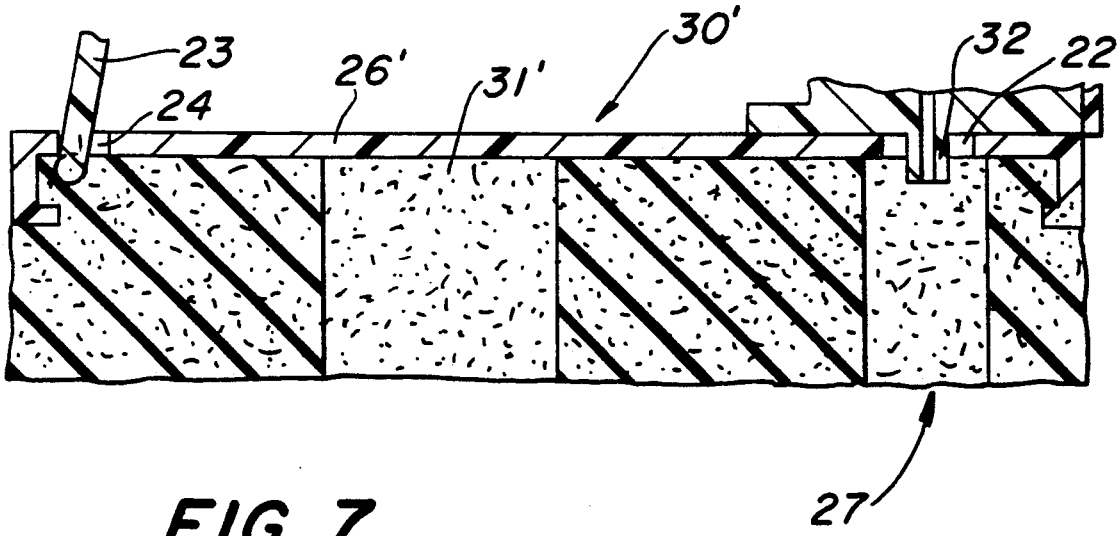
FIG. 7

BRUSH WITH AUTOMATIC FLOW CONTROL VALVE

FIELD OF THE INVENTION

The present invention relates generally to the field of brushes and more particularly is directed to a brush adapted to be connected to a conventional garden hose or other water supply under pressure. The present invention also includes an automatic water shutoff and flow control valve and has specific application for cleaning cars and the like.

BACKGROUND OF THE INVENTION

It is known to employ various types of brushes which may be connected to a source of water under pressure, for example, a conventional garden hose. Such brushes include bristles suitable for polished or painted surfaces, such as the painted polished surfaces of motor vehicles and similar surfaces which may be conveniently cleaned using water.

One common drawback of conventional brushes that directly receive a water supply is the fact that there is no convenient method for shutting off water to the brush other than by turning the faucet handle at the hose connection. Moreover, it is desirable to limit the amount of water being applied during use of the brush so as to prevent waste, to prevent the user from becoming soaked, and to provide cleansing soap with sufficient contact time on the surface of the car to provide deep cleaning.

A brush having a water shutoff control valve is shown in U.S. Pat. No. 4,895,468 which issued on Jan. 23, 1990 to Applicant. The present invention is considered an improvement over this previously-described brush for various reasons.

SUMMARY OF THE INVENTION

The present invention is a brush including an integral automatic water control valve therein. The brush of the present invention generally includes a brush portion, a handle portion and a valve actuation portion. The brush portion generally includes an upper rigid member from which extend a series of bristles, a sponge or the like. Mounted within the bristles of the brush portion is a sponge-like element for receiving and absorbing a soap material to be used for cleaning. The porous nature of the sponge tends to absorb the soap material and release the soap slowly during the brush strokes over the surfaces to be cleaned. The rigid portion of the brush is attached to the handle portion. The actuation portion is pivotably attached to the handle portion. Extending through the actuation portion into the handle portion is a flow conduit or tubing made of a flexible material. The flow conduit communicates with a passageway within the handle portion which directs water flow into the bristles of the brush. Adjacent the pivot of the actuating portion with the handle portion is a roller which engages and compresses the passageway formed by the flexible tubing. In the normal, rest position the roller closes the tubing passageway against an abutment formed as part of the handle portion. By pivoting the actuation portion about its pivot, the roller rolls along the tubing to enable the tubing to open a sufficient amount to permit the flow of water to be directed through the passageway into the brush. Upon release of the actuation portion, the water pressure causes the roller to return to its engagement position and shut off water flow. It is contemplated that the amount of angular rotation of the actuation portion about the pivot will vary the flow of water through the valve and into the brush portion.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 6 shows a cross-sectional view of the hose connection portion of the invention as taken along line 6—6 in FIG. 1.

FIG. 7 shows a cross-sectional view of an alternate brush portion of the present invention.

DETAILED DESCRIPTION OF THE INVENTION

Figure 1:
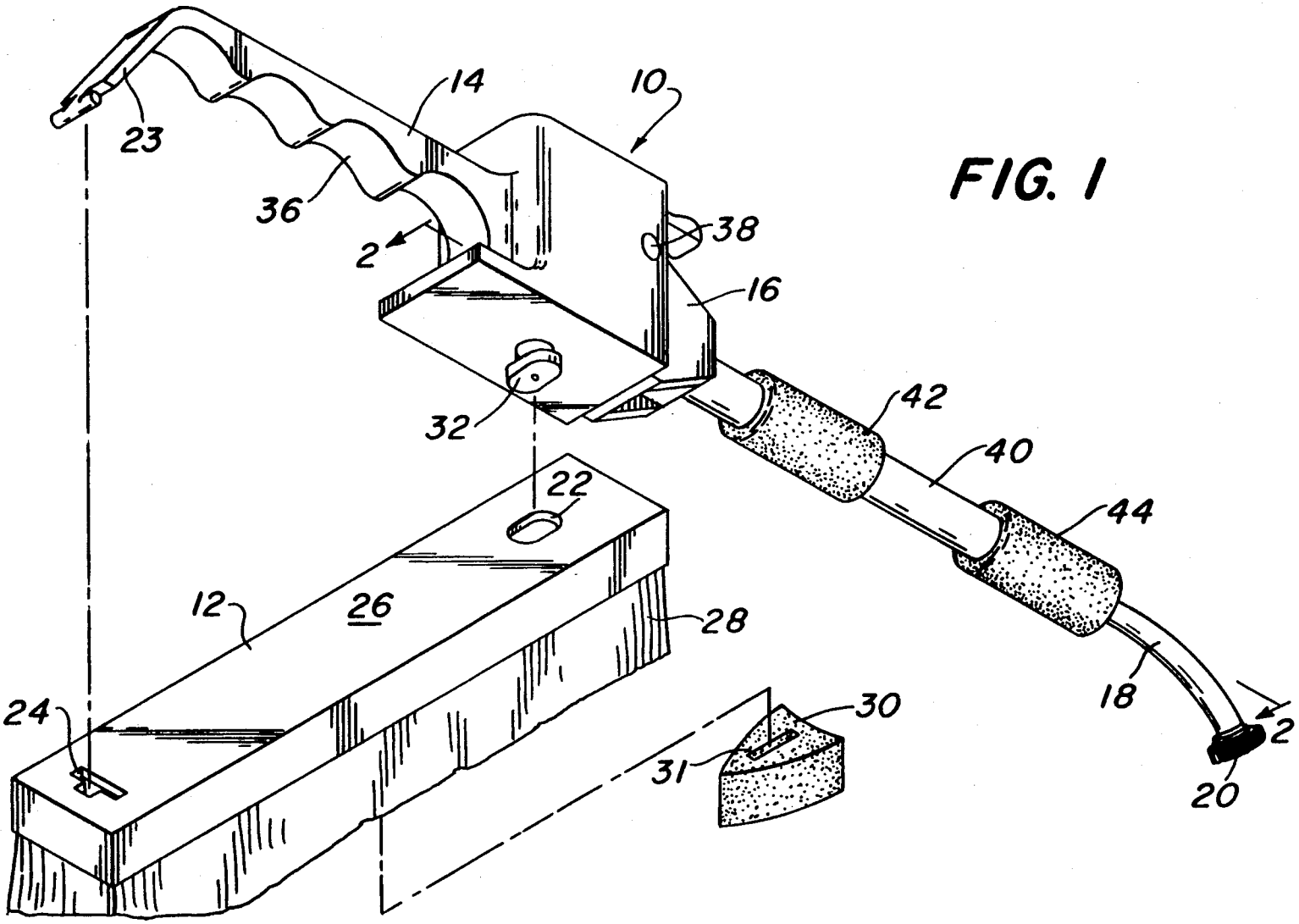
FIG. 1 shows an exploded view of a brush in accordance with the present invention.

In the drawings where like numerals indicate like elements, there is shown a brush as generally contemplated by the present invention and designated generally by the numeral 10. The brush 10 includes a brush portion 12, a handle portion 14, and an actuation portion 16. Extending from thee actuation portion is a connection portion 18 generally in the form of a hollow flexible tube having a threaded socket 20 at its extended end. Socket 20 is suitable for connection to the threaded end of a garden hose (not shown) or other water supply under pressure.

As illustrated in FIG. 1, the elements of the brush 10 may be assembled to form an integral unit. The handle portion 14 is adapted to engage the brush portion 12 by means of slots 22 and 24. The slots 22, 24 are generally formed in a rigid block 26 which forms a part of the brush portion 12 and from which bristles 28 extend. As sponge 30 is secured to the block 26 of the brush portion 12. Sponge 30 is generally contemplated to be positioned between the bristles 28 of the brush portion 12. Within the sponge 30 there is provided a slot 31 forming an opening through the sponge 30. The slot 31 is contemplated to receive a quantity of liquid soap prior to using the brush 10. The slot 31 is sized for measuring the desired quantity of soap for a single wash of a car. The slot preferably has dimensions of 1 inch by 3/16 inch and is approximately 1½ inches deep. The soap is absorbed into the sponge 30 and periodically released by the brushing action during use of the brush 10. As illustrated in FIG. 7, it is contemplated that the brush portion 12 may comprise a sponge portion 30', replacing the bristles. Sponge portion 30' includes a support block 26' and a sponge 28'. Sponge 28' includes an opening 27 and a slot 31'.

The handle portion 14 is attached to thee block portion 26 of the brush portion 12 of the embodiment shown in FIG. 1, or support block 26' of the sponge portion 30' of the embodiment of FIG. 7, by means of projection 32 engaging within slot 22. The projection 32 generally includes a shaft portion 32A and a head portion 32B. The projection 32 generally forms a "T" when viewed from an end of the brush with the head portion being spaced away from the bottom of the handle portion. The head portion of projection 32 corresponds in profile to the shape of the opening of the slot 22. Upon insertion of the projection 32B into the slot 22, the handle 14 may be rotated about the axis of the projection so as to lock the head portion to the block 26. Thereafter a second "T" shaped projection 23 is engaged within the slot 24 as shown in FIGS. 1 and 7. The handle portion 14 has plural recesses forming a gripping surface 36 for enabling the user to hold the brush 10 with one hand.

As can be seen in FIGS. 2-5, the actuation portion 16 comprises a body which is attached to the handle portion 14 by means for pivot 38. As illustrated more particularly in FIG. 5, the pivot 38 is formed by two projecting tabs of the body that are engaged within aligned openings 14A and 14B in the handle portion 14. A hole 16A is provided within the actuation portion body and from which extends a hollow shaft 40 having gripping members 42 and 44 thereon. The hollow shaft 40 may be as long as desired and preferably extends for approximately two feet so that the brush 10 forms a wand-like element. The extended shaft 40 assists in reaching the middle of the car during cleaning. The gripping members are preferably made of a foam-like material and are slid onto the shaft 40.

Figure 2:
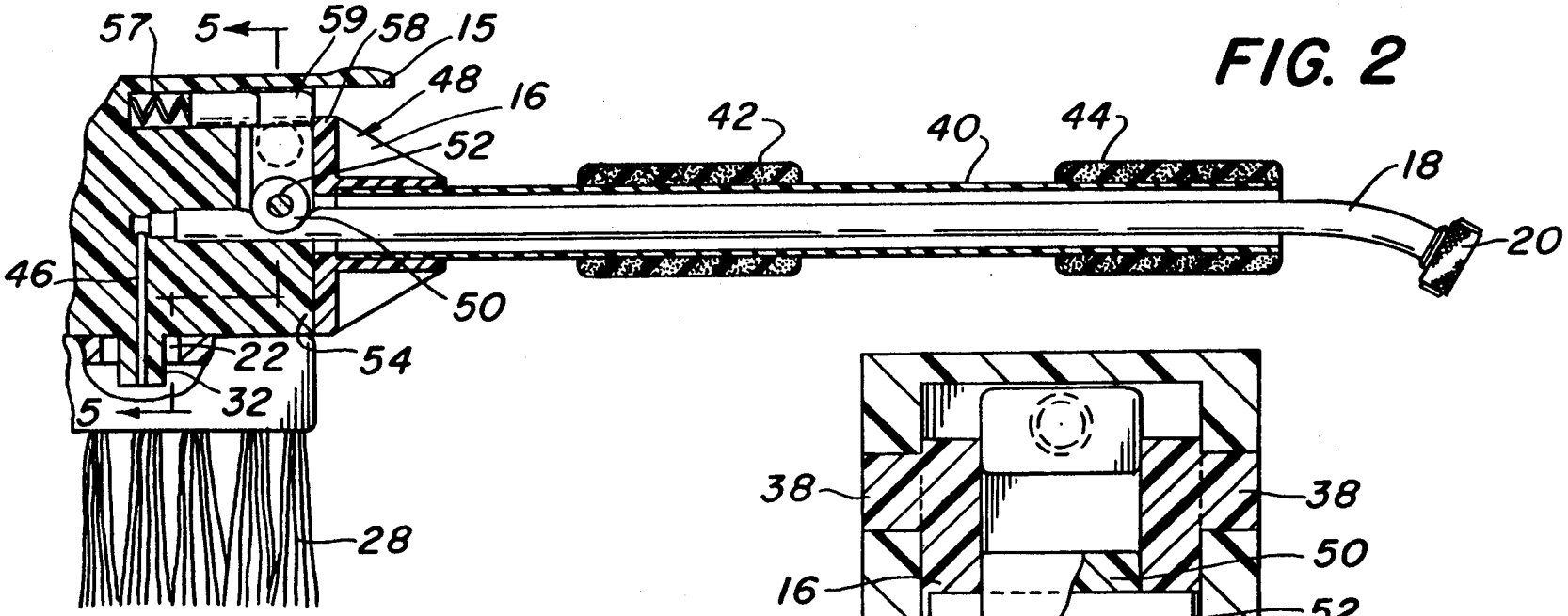
FIG. 2 shows a cross-sectional view of a portion of the brush shown in FIG. 1 as taken along line 2—2 in FIG. 1.
Figure 5:
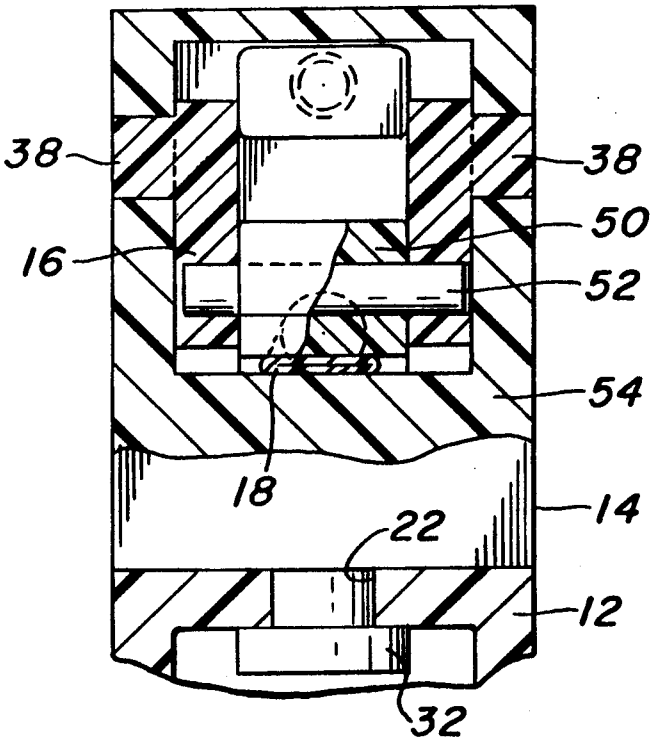
FIG. 5 shows a third cross-sectional view as taken along line 5—5 in FIG. 2.
Figure 3:
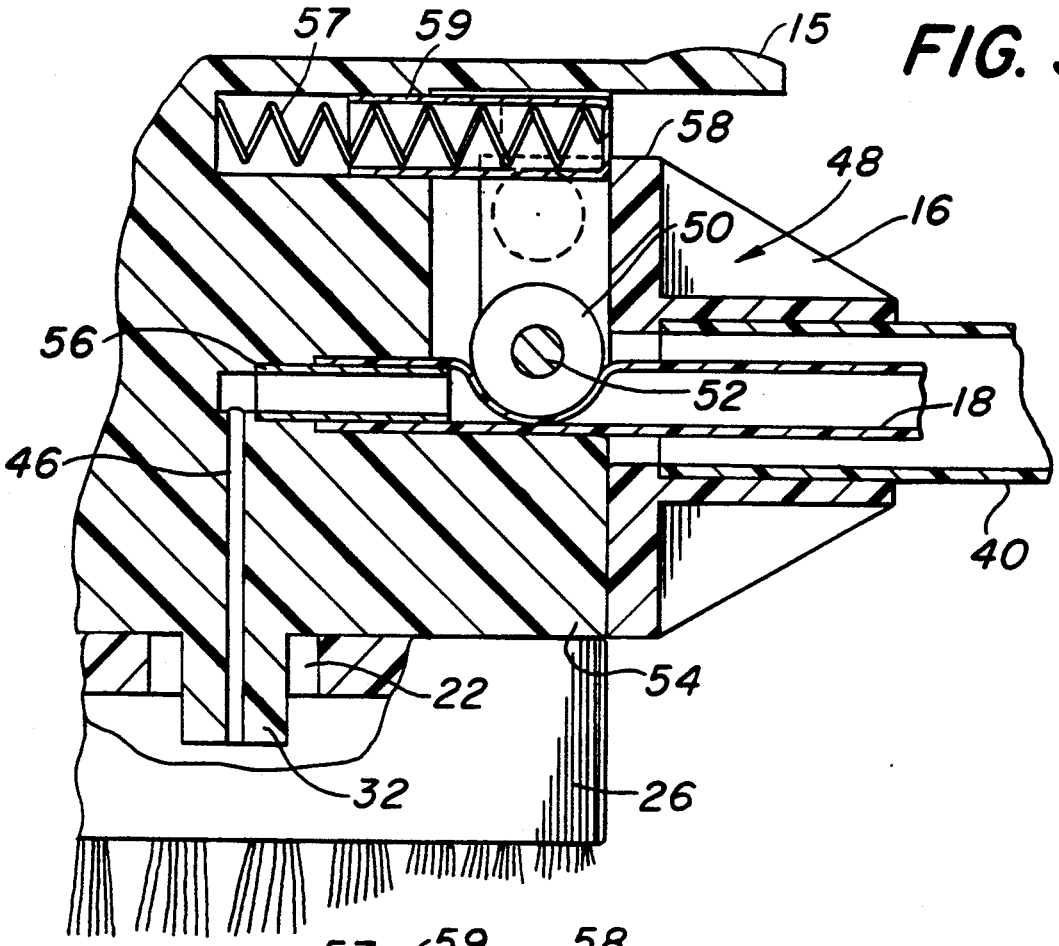
FIG. 3 shows a cross-sectional view of the valve portion of the brush as shown in the closed position.

As illustrated in FIG. 2, the flexible tubing 18 forms a fluid passageway through the shaft 40 and communicates with the interior of the handle portion 14. The handle portion 14 includes a fluid passageway 46 that extends through its midsection and through the first projection 32. The flexible tubing 18 extends through hollow shaft 40 and terminates at its inner end within a bore 40A in the midsection of the handle portion. The bore 40A communicates with passageway 46. Formed as part of the actuation portion 16 is a valve means 48 which is adapted to engage the outer surface flexible tubing 18 adjacent the point at which it enters bore 40A. The valve means 48 generally comprises roller 50 mounted on a shaft 52. The shaft is located within a bore 52A and an aligned hole 52B in the actuation portion 16 (See FIG. 5). The valve means 48 also includes a block 54 formed as part of the handle portion 14. As shown in FIGS. 2, 3, and 5, the roller 50 of the valve means 48 closes the passageway formed by tubing 18 to prevent fluid from passing through passageway 46 and into the bristles 28 of brush portion 12. The operation of the valve means will be described below with reference to FIGS. 3-5.

FIGS. 3 and 5 generally show the valve means 48 in the closed position preventing fluid from passing through tubing 18 into the passageway 46 formed in handle portion 14. The closing of the valve means 48 is created by roller 50 which is freely rotatable about the shaft 52. Actuation portion 16 is pivotable with respect to handle portion 14 about pivot 38. In the position shown in FIGS. 3 and 5, the flexible tubing 18 is squeezed together between the roller 50 and the block 54. Thus, opposite surfaces of the tubing 18 engage one another and close off the water passageway through the tubing and prevent flow into the passageway 46 of handle portion 14. The flexible tubing 18 is connected to the passageway 46 formed within handle portion 14 by means of a pipe 56. The pipe 56 is inserted within the tubing 18 and at its opposite end into a slot formed within the handle portion 14. The slot within handle portion 14 communicates with the passageway 46. The relative diameters of the slot, the pipe 56 and the tubing 18 are generally contemplated to form a tight fluid seal, thus, preventing leakage upon assembly.

Figure 4:
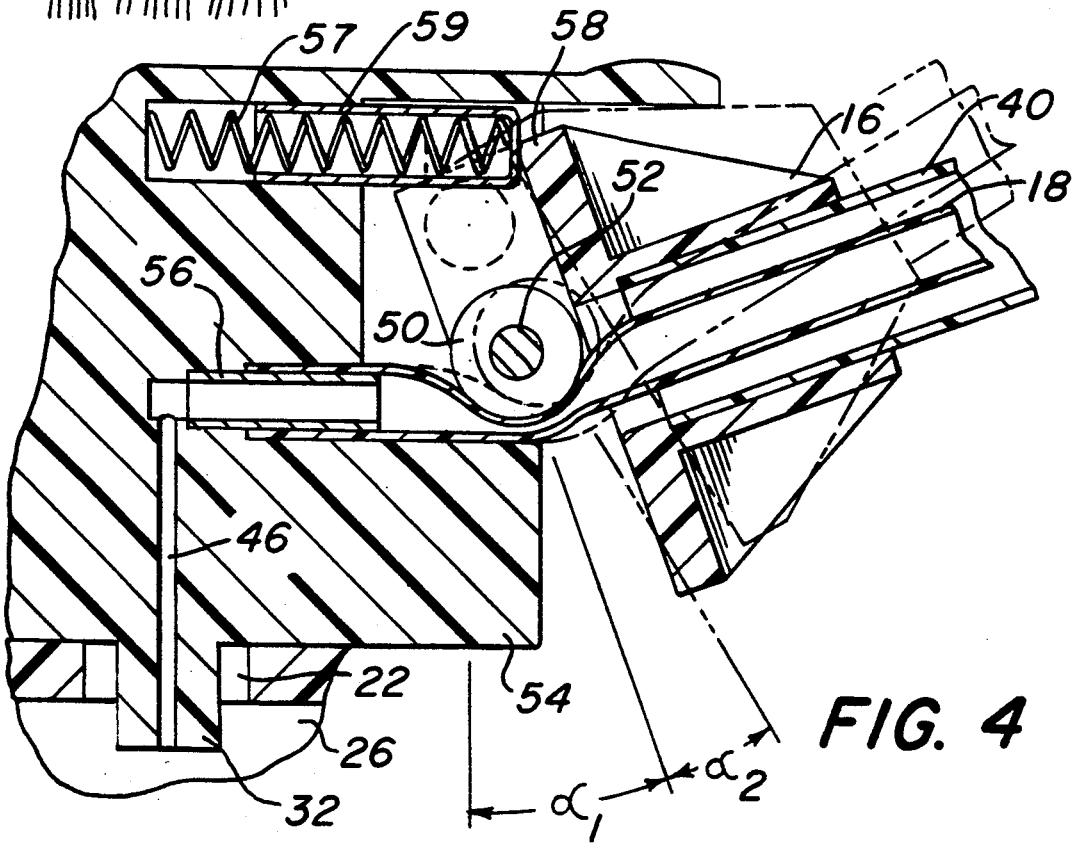
FIG. 4 shows a second cross-sectional view of the valve portion of the brush as shown in the open position.

As illustrated in FIG. 4, the valve means 48 is opened by pivoting the actuation portion 16 with respect to handle portion 14 about pivot 38. This pivoting motion causes the roller 50 to roll along the surface of the flexible tubing while it arcs away from block 54. The pivoting motion of the roller 50 thus allows the passageway formed through the tubing 18 to open partially. A spring 57 and its associated cap 59 are positioned within the handle portion 14 for engagement with a contact surface 58 on the actuation portion 46. The spring 57 resists rotation of the actuation portion 16 about the pivot 38 in the counterclockwise direction shown in FIGS. 2-4. Flow into the passageway 46 of handle portion 14 is controlled by the amount of opening or the size of the angle $\alpha$. As can be seen in FIG. 5, the cap 59 is preferably sized to fit between opposite sides 16B and 16C of the actuation portion 16, such that the opposite ends of the pivot 38 cannot bend inwardly and disengage from the handle portion 14.

The angle $\alpha_1$ as illustrated in FIG. 4 is contemplated to be generally small. Preferably, only a small amount of water is provided into the bristles of the brush at any one time during normal use of the brush 10, that is only enough water to soak the bristles 28 and to permit the application of a soapy liquid onto the car surface. This limited amount of water provides sufficient liquid for cleaning the car surface and sufficient lubrication to resist scratching the paint or the like, while preventing a flow of liquid which would cause dripping and move the soap over the surface of the car at too great a speed.

It is generally contemplated that the actuation of the valve means 48 will be automatic during the use of the brush 10. A person washing the ar would generally grip shaft 40 with two hands on griping portions 42 and 44. Upon the brush receiving a slight pull or drag due to the lack of moisture, the actuation portion 16 would tend to pivot about pivot 38 and open the valve means 48 to a first or partially open position designated by the angle $\alpha_1$. This is a direct result of the slight increase in drag due to the lack of moisture. Thus, the angling of the actuation portion 16 with respect to the handle portion 14 and its attached brush portion 12 cause the valve means 48 to open. Upon sufficient fluid being provided through passageway 46 into the bristles 28 of the brush portion 12, the fluid pressure within the tubing 18 tends to close the valve 48. The automatic closing of the valve means is a result of the roller 50 engaging the tubing with pressure being provided on the input end thereof. This pressure tends to cause the roller 50 to rotate about its axis 52 and to cause actuation portion 16 to pivot in a clockwise direction about pivot 38. The force within the tubing 18 due to the fluid pressure is similar to the pressure that one would feel if one would attempt to squeeze the tubing between two fingers. The fluid pressure creates a force which tends to open the tubing on the input side of the roller 50.

In the operation of the preferred embodiment, the maximum angle $\alpha_1$ may be approximately 5°. As illustrated, the angle $\alpha_1$ is much greater than 5°. Such is permissible depending on the amount of flow that is desired and the length of the pivot about 38. Relatively small angles will provide a repetitive on/off flow control into the passageway 46 without large amounts of water passing therethrough. If too much water is permitted to pass into the brush portion 12 an excessive soaking of thee sponge 30 and the waste of soap results. In addition, too much water being applied during use will also result in the soap having insufficient contact time on the car surface so that the washing action is messy.

The actuating portion is arranged to pivot past the partially open position to a fully open position, i.e., angle $\alpha_2$. In this position the valve means enables substantially a full flow of water into the passageway 46 from the tubing 18. Because of the relative diameters of the brush portions and the water pressure into the tubing, the actuation of the valve means to angle $\alpha_2$ will result in a flow of water that projects or spouts from the brush portion 14 with sufficient force to rinse the soap from the car surface. Opening 27 in the sponge portion 30' as illustrated in FIG. 7 is provided to permit the spouting flow of water to be directed through the sponge 28' in a similar manner.

The sponge 30 and 28' of the present invention is generally contemplated to be extremely porous. Approximately one ounce of cleaning fluid may be provided to the sponge through openings 31 and 31' and be sufficient for cleaning an entire car. The soap is retained in the sponge, being release to the surfaces to be cleaned in a progressive nature depending on the flow of water and the brushing action. If there was a continual flow of water, i.e., uncontrolled the amount of fluid would be far greater than desired. Manifestly the present invention contemplates a progressive release of water only in sufficient amounts to continue the cleaning action.

The brush as illustrated herein can also be actuated manually. To that end, adjacent the pivot 38 on the handle portion 14 is a thumb tab or extension 15. During normal use, the user may grip the shaft 40 in one hand and apply his/her thumb to the extension 15. When the user desires an opening of the valve means 48, force is applied to the extension 15, causing the actuation means 16 to rotate counterclockwise with respect to the handle position about the pivot 38. This pivoting action results in the valve means 48 opening and water flowing into the bristles 28 or sponge 30'. Releasing the force on the extension 15, results in the valve means 48 closing. Closure is automatic due to the force of spring 57 and the water pressure in tubing 18. Thus, the flow of water and the amount of that flow can be controlled manually or automatically.

Another feature of the present invention is the engagement of the tubing 18 close to the brush portion 12. This provides a long extension of tubing 18 within shaft 40. Thus, the flexible tubing 18 is free to twist as the brush is being used. It is generally contemplated that the tubing 18 will be of a more flexible material than a typical garden hose and, because of its diameter and the like, will be free to flex at all angles without causing the hose to prevent further movement during cleaning of the surfaces of the car. Other advantages of the invention are also contemplated.

Illustrated in FIG. 6 is the connecting member 20 attached to the projected end of the flexible tubing 18. This connection or socket 20 includes an internally threaded sleeve 60. The threads of the sleeve 60 are adapted to engage the threads of a typical garden hose or the like. The connecting member also includes a plug 62 inserted into the sleeve 60 and into the flexible tubing 18. The plug 62 includes a central passageway 64, an enlarged frusto-conical head portion 66, and an abutment portion 68. The head 66 is engaged within the passageway of the tubing 18 and is secured, i.e., press-fit, therein. It is contemplated that the head 66 is insertable into the tubing 18 a sufficient distance to bunch thee tubing material at its contact with the abutment portion 68. This bunched tubing material 69 engages a floating sleeve 70 mounted within sleeve 60. Thus, the tubing is rigidly secured to the floating sleeve in a fluid tight arrangement. Also, sleeve 60 is free to rotate about the floating sleeve 70 so that its may be screwed onto the garden hose or the like (not shown). Tabs 74 are provided on the sleeve 60 to assist in this rotational attachment. Also, a washer 72 is provided within the opening of the sleeve 60 to further seal the attachment of the hose.

The present invention may be embodied in other specific forms without departing from the spirit or essential attributes thereof, and accordingly, reference should be made to the appended claims, rather than to the foregoing specification, as indicating the scope of the invention.

I claim:

1. A brush device for cleaning an object utilizing water, said brush device comprising a handle portion having gripping means thereon, a brush portion releasably secure to said handle portion, an actuation portion pivotably attached to said handle portion and arranged to be pivoted about a axis with respect to said handle portion, a flexible tubing adapted for attachment to a source of water under pressure, said flexible tubing serving to direct the flow of water to said brush portion, and an automatic control valve, said automatic control valve comprising valve means coupled to said brush portion and comprising roller means mounted on said actuation portion and arranged to roll along a portion of said flexible tubing in an arc about said axis, said actuation portion being arranged to be located in a first rotational position whereupon said roller means squeezes a portion of said flexible tubing to close it from the passage of water therethrough, said actuation portion being arranged to be pivoted in a first rotational direction to a second rotational position whereupon said roller means rolls along said portion of said flexible tubing in an arc about said axis to permit said tubing to open partially so that a small flow of water passes through said flexible tubing and out of said brush portion.

2. The brush device of claim 1 wherein said actuation portion is arranged to be pivoted in said first rotational direction past said second rotational position to a third rotational position, whereupon said roller means rolls along said portion of said flexible tubing in an arc about said axis to permit said tube to open further so that a larger flow of water passes through said flexible tubing and out of said brush portion.

3. The brush device of claim 2 additionally comprising biasing means to cause said actuation portion to rotate in a second rotational direction opposite to said first rotational direction until said actuation portion is in said first rotational position, whereupon said roller means again squeezes said portion of the flexible tubing closed so that the flow of water through said flexible tubing ceases.

4. The brush device of claim 3 wherein said biasing means comprises spring means for applying a bias force to resist the pivoting of said actuation portion in said first rotational direction.

5. The brush device of claim 3 wherein said biasing means comprises tab means arranged to be pressed by the thumb of a user of said brush device while said user holds a portion of said actuation portion in his/her hand to cause said actuation portion to pivot in said second rotational direction.

6. The brush device of claim 1 wherein the pressure of water provided into said brush device through said flexible tubing tends to cause said flexible tubing to cause said roller means to roll along said flexible tubing in an arc about said axis in a second rotational direction, opposite to said fist rotational direction, until said actuation portion is in said first rotational position so that said roller means again squeezes said portion of the flexible tubing closed whereupon the flow of water through said flexible tubing ceases.

7. The brush device of claim 1 additionally comprising reservoir means for holding a cleaning preparation within said brush so that said water may carry said cleaning preparation onto the object to be cleaned.

8. The brush device of claim 7 wherein said reservoir means comprises a porous sponge.

9. The brush device of claim 1 wherein said brush portion comprises a block from which plural bristles extend.

10. The brush device of claim 1 wherein said brush portion comprises a block from which a porous sponge projects.

* * * * *